United States Patent [19]

Glang et al.

[11] Patent Number: 4,824,289

[45] Date of Patent: Apr. 25, 1989

[54] SEALING PROFILE FOR TUNNEL SEGMENTS

[75] Inventors: Siegfried Glang, Hamburg; Werner Grabe, Winsen, both of Fed. Rep. of Germany

[73] Assignee: Phoenix Aktiengesellschaft, Hamburg, Fed. Rep. of Germany

[21] Appl. No.: 82,071

[22] Filed: Aug. 5, 1987

[30] Foreign Application Priority Data

Aug. 8, 1986 [DE] Fed. Rep. of Germany ..... 3626890
Aug. 8, 1986 [DE] Fed. Rep. of Germany ..... 3626891

[51] Int. Cl.[4] ..... E21D 11/14

[52] U.S. Cl. ..... 405/152; 52/396; 277/207 R; 404/47; 404/50; 405/150

[58] Field of Search ..... 405/152, 150, 153, 135, 405/136; 52/396; 277/12, 207 R; 404/47, 48, 49, 64, 68

[56] References Cited

U.S. PATENT DOCUMENTS 4,195,850 4/1980 Berger et al. ..... 405/135

FOREIGN PATENT DOCUMENTS 2833345 2/1980 Fed. Rep. of Germany ..... 405/152
3008711 9/1981 Fed. Rep. of Germany ..... 405/152

*Primary Examiner*—Dennis L. Taylor
*Attorney, Agent, or Firm*—Collard, Roe & Galgano

[57] ABSTRACT

There is provided a sealing profile formed of rubber or rubber-like material for tunnel segments having a recess therefor extending therearound, the profile having a base side facing the segment and a back side facing away from the segment, a plurality of longitudinally extending parallel flutes in the base side, lateral flanks extending angularly from the base side, a plurality of longitudinally extending parallel ducts, and at least one centrally disposed bridge through extending from the base side to the back side without impairment in its supporting effort by a longitudinal duct.

12 Claims, 4 Drawing Sheets

SEALING PROFILE FOR TUNNEL SEGMENTS

The present invention relates to a sealing profile for tunnel segments, the tunnel segments having a recess extending therearound to accept the profile.

Sealing profiles of the type with which the present invention is concerned are disclosed in DE-PS No. 28 33 345, DE-Design Pat. No. 85 02 036, DE-Design Pat. No. 85 21 068 and DE-Design Pat. No. 85 32 264 and have been successfully used in tunnel construction which utilize casings or segments made of concrete, cast iron, steel or steel reinforced concrete.

Such profiles are expected to satisfy the following requirements:

1. The forces which must be overcome when the segments are screwed or urged together should be as low as possible.

2. Proper support within the segment grooves.

3. Contact stress should be as high as possible resulting in high sealing efficiency even if the sealing faces of the profiles are not perfectly aligned.

4. The stress relaxation should be as low as possible over the service life anticipated for the tunnel.

In the last few years, profile development has concentrated mainly on meeting the first two of the above requirements and also on practical applications, which has led to the arrangement of flutes and ducts in the cross section of the profile in particular geometrical layouts, with the result that stiffness is very evenly distributed across the width of the profile. Such profiles, however, because of inadequate contact stress and excessive tendency to stress relaxation, do not meet increased requirements with respect to sealing efficiency, which must be assured on a long-term basis, because the force of reaction available when the profile is pressed together is divided through the total width of contact, which results in low contact stress and, furthermore, stress relaxation is accelerated by the numerous ducts disposed in such a profile.

Therefore, the object of the present invention is to develop a sealing profile for a tunnel tube segment which satisfies requirements 3 and 4 while taking into account requirements 1 and 2, so that even tunnels built at a depth of more than 100 meters can be safely sealed on a long-term basis.

This object is accomplished in accordance with the present invention by the provision of a sealing profile for tunnel segments formed of rubber or rubber-like material having longitudinally extending parallel flutes on the base side thereof, lateral flanks extending angularly from the base side, and parallel, longitudinally extending ducts with at least one centrally disposed bridge through extending from said base side to the back side of the profile unimpaired in its supporting effect by a longitudinal duct. The through-extending bridge leads to a concentration of the force of reaction on such bridge as such force is mobilized when the profile is pressed together, with the result of stress concentration and thus increased sealing efficiency. Furthermore, substantially less stress relaxation occurs with such a bridge not weakened by a longitudinal duct.

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

Figure 3A:
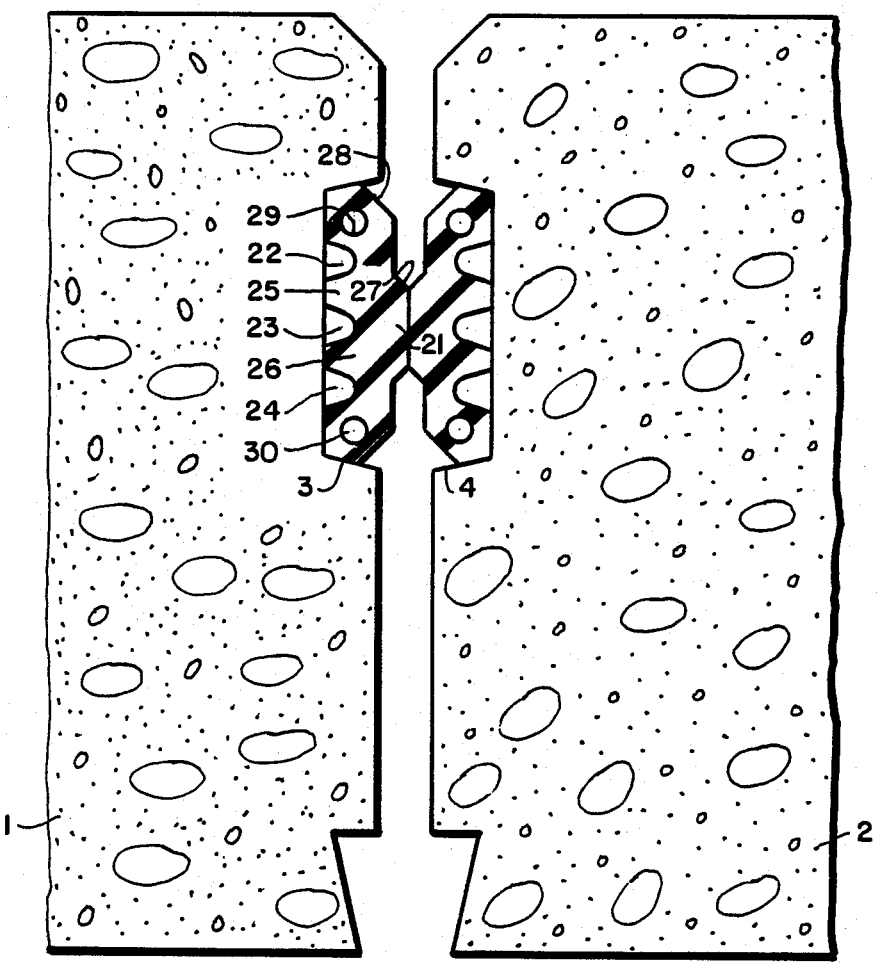
Figure 3B:
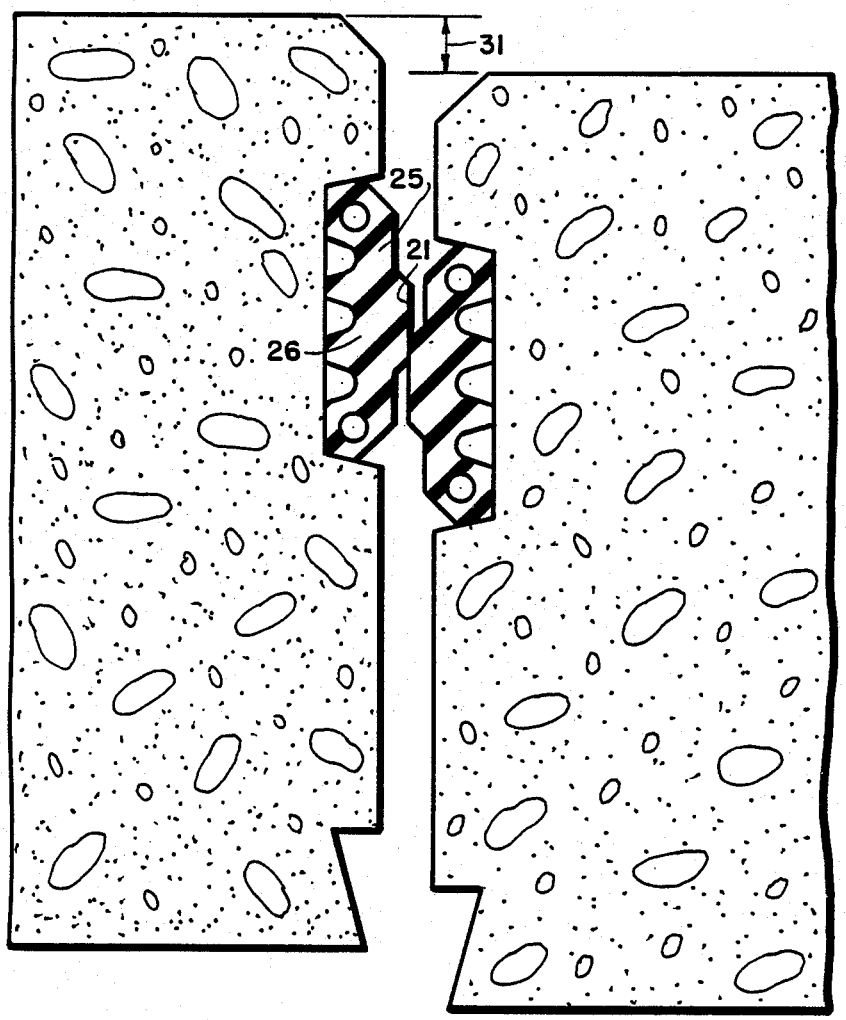
Figure 4:
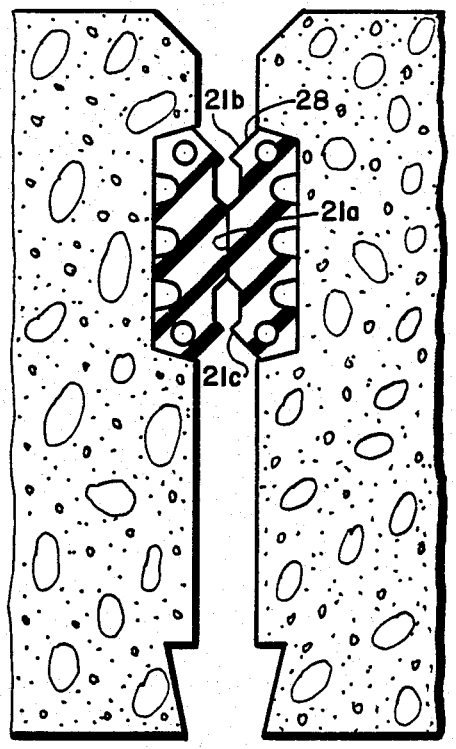
Figure 5:
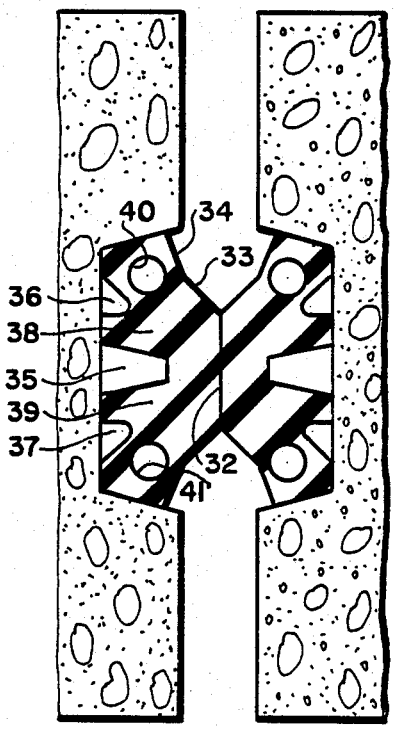

FIG. 3*a* cross-sectional view of another embodiment of the sealing profile of the present invention;

FIG. 3*b* is a view of the profile of FIG. 3*a* showing the facing profiles to be off-set;

FIG. 4 is a cross-sectional view of yet another embodiment of the sealing profile of the present invention; and FIG. 5 is a cross-sectional view of still another embodiment of the sealing profile of the present invention.

Figure 1:
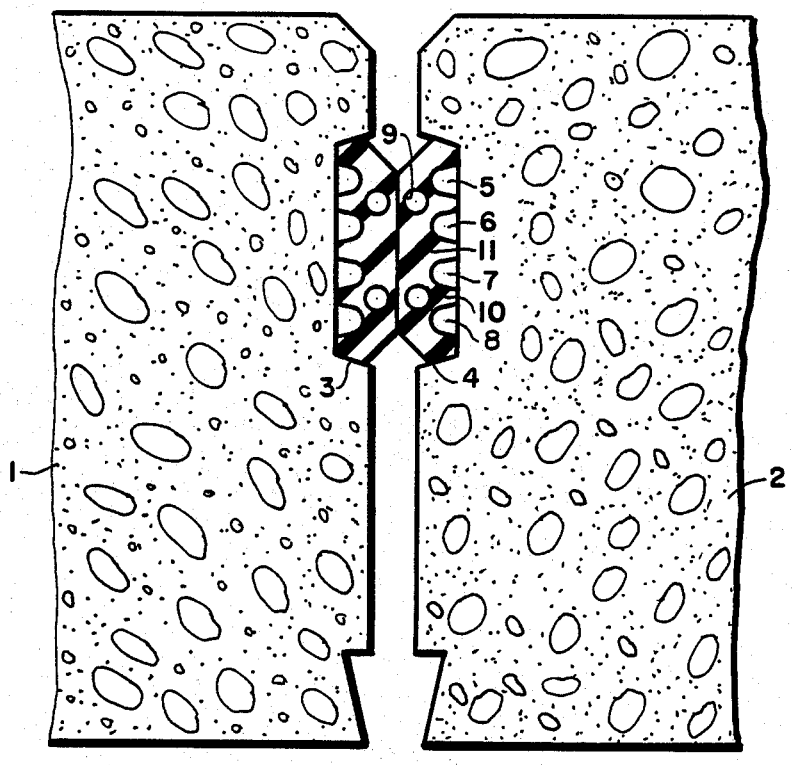
FIG. 1 is a cross-sectional view of a pair of facing sealing profiles according to the present invention installed in the recesses of facing tunnel segments.

Now turning to the drawings wherein the profiles are shown in the unstressed state prior to compression, there is shown in FIG. 1 two tunnel segments 1 and 2 having grooves 3 and 4, respectively, into which are adhered the sealing profiles. In the installed condition, the profiles contact each other back to back, whereby the back of the profile has a plane or level surface. Each of the profiles has four flutes 5 to 8 on the base side thereof. Furthermore, the profile has two ducts 9 and 10 as well as a central, supporting bridge 11 through-extending from the base side to the back side of the profile The arrangement of four flutes creates two additional bridges 12 and 13, which have their supporting efficiency reduced by ducts 9 and 10 in the present embodiment, in order to produce a stress peak in center bridge 11. As the profiles are compressed or urged against each other when segments 1 and 2 are joined by screw connection, the reaction force produced by this operation is concentrated in the solid through-extending bridges 11, with the result of high contact stress and sealing efficiency between the profiles.

Figure 2:
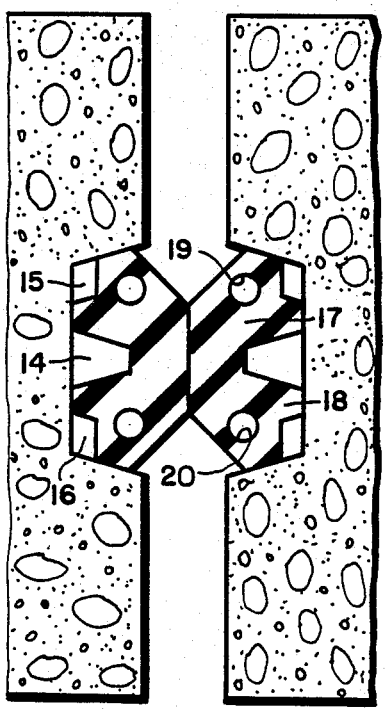
FIG. 2 is a cross-sectional view of another embodiment of the sealing profile according to the present invention.

In FIG. 2 there is shown a profile also having a plane or level back. Through-extending bridges 17 and 18 are disposed between the center flute 14 and each of the two outer flutes 15 and 16, respectively. Above the two outer flutes 15 and 16, which extend into the corner zone of the profile, identically shaped ducts 19 and 20, respectively, are arranged so that their center lines are on the same level as the top edge of center flute 14.

In FIG. 3*a*, two sealing profiles are adhered in grooves 3 and 4 of segments 1 and 2, respectively. The back of the profiles have an elevation 21 of about 2.5 millimeters, creating an irregularly shaped back of the profile. The arrangement of such an elevation further reduces the width of contact between the two facing profiles, in particular if the two axes of the tunnel segments should be displaced or off-set with respect to each other because of unavoidable installation inaccuracies. The profile according to FIG. 3*a*, furthermore, has three identically shaped flutes 22, 23 and 24, which are equally spaced from each other. Through-extending bridges 25 and 26 are disposed between center flute 23 and the two outer flutes 22 and 24, respectively. The elevation 21 in the back of the profile is arranged in the direction of the action of forces of the two through-extending bridges 25 and 26. In the present embodiment, the pitch 27 of elevation 21 is about equal to the pitch of lateral flank 28. Identically shaped ducts 29 and 30 are disposed between the outer flutes 22 and 24, respectively, and each lateral edge of the profile, so that the center line of each duct is disposed at the same level as the top edge of the three flutes. Thus, as the profiles are compressed against each other when segments 1 and 2 are joined by being screwed together, the reaction force produced thereby is concentrated in the solid, through-extending bridges 25 and 26, resulting in high contact stress and sealing efficiency between the profiles.

If the profiles shown in FIG. 3*a* are displaced relative to each other by a displacement as shown in FIG. 3*b*, the width of contact is reduced and the stress again increased.

In FIG. 4 there is shown the same profile as is illustrated in FIGS. 3*a* and 3*b* with respect to the number and arrangement of the flutes and ducts. However, in addition to the center elevation 21*a*, this profile has two additional elevations 21*b* and 21*c* on the edges at the back of the profile. In this embodiment, elevations 21*b* and 21*c* have the same pitch as the flanks 28. Efficient sealing is achieved by means of such edge elevations even with extreme displacement of the profiles relative to one another.

In FIG. 5 there is shown a profile with an irregular back as well, which is formed by the elevation 32. The pitch 33 of this elevation is not the same as the angle of pitch of lateral flank 34. As opposed to the profile of FIGS. 3*a* and 3*b*, elevation 32 is formed without transition, i.e., without the presence of any intermediate step from lateral flank 34. Through-extending bridges 38 and 39 are disposed between center flute 35 and each of the two outer flutes 36 and 37, respectively. The center flute being wider and deeper than the two other flutes. This profile has identically shaped ducts 40 and 41 disposed with displacement sideways above the outer flutes 36 and 37, respectively.

All profiles described above consist of a rubber mixture based on polychloroprene, EPDM, nitrile rubber. The four frame corners of the profile are produced by injection molding. During this injection molding step, the ducts are normally sealed with conical plugs.

Although several embodiments of the present invention have been shown and described, it will be obvious that many changes and modifications may be made thereunto without departing from the spirit and scope of the invention.

What is claimed is:

1. In a sealing profile formed of rubber or rubber-like material for tunnel segments having a recess therefor extending therearound, said profile having a base side facing said segment and a back side facing away from said segment, a plurality of longitudinally extending parallel flutes in said base side, lateral flanks extending angularly from said base side, and a plurality of longitudinally extending crossed-sectionally closed parallel ducts disposed above the base side, the improvement comprising said sealing profile including at least one centrally disposed bridge through extending from said base side to said back side without impairment in its supporting effect by a longitudinal duct, said at least one bridge being located only in the center region of said sealing profile so as to result the concentration of the force of reaction in said bridge and less stress relaxation therein during use.

2. The sealing profile as defined in claim 1, wherein said centrally disposed bridge is disposed on the axis of symmetry of said profile and said profile further includes two additional bridges formed around said centrally disposed bridge by the arrangement of four identically shaped flutes, the supporting effect of said additional bridges being reduced in the region facing away from said base side by two identically shaped longitudinal ducts, and the back side of said profile is planar.

3. The sealing profile as defined in claim 2, wherein the bottom edge of said ducts is disposed at a level no lower than the top edge of said flutes.

4. The sealing profile as defined in claim 1, wherein said profile includes three flutes, the center one being deeper and wider than the other two, an identical duct disposed above each of the outer flutes, thereby defining a through extending bridge disposed between said center flute and each outer flute, the back side of said profile being planar.

5. The sealing profile as defined in claim 4, wherein the center lines of said ducts are on line with the top edge of said center flute.

6. The sealing profile as defined in claim 1, wherein said back side has at least one elevation thereon.

7. The sealing profile as defined in claim 6, having a single elevation on the back side thereof arranged in the direction of the action of forces of the through extending bridge, the angle of pitch of said elevation being equal to that of the lateral flanks.

8. The sealing profile as defined in claim 6, wherein there are three elevations, one arranged in the direction of the action of forces of the through extending bridge and two on the edge of the back side of the profile, the angle of pitch of the elevations being equal to that of the lateral flanks.

9. The sealing profile as defined in claim 7, wherein there are two through extending bridges symmetrically disposed about the center of said sealing profile separated from each other by a flute.

10. The sealing profile as defined in claim 9, wherein there are three flutes, the flute separating the two bridges having the same shape as the two other flutes, and a duct is disposed between each outer flute and the associated lateral flank of the profile, the two ducts being equal.

11. The sealing profile as defined in claim 10, wherein the center line of the ducts is disposed on the line of the top edge of the flutes.

12. The sealing profile as defined in claim 9, wherein there are two three flutes, the separating flute being wider and deeper than the outer flutes, and a duct is disposed laterally displaced above each of the outer flutes, said ducts being equal.

* * * * *